US006546885B1

(12) United States Patent
Francke

(10) Patent No.: US 6,546,885 B1
(45) Date of Patent: Apr. 15, 2003

(54) COLLAPSIBLE CATAMARAN

(76) Inventor: Rafael Francke, Multihulls West, Inc., 4106 Huron Ave., Culver City, CA (US) 90232

( * ) Notice: Subject to any disclaimer, the term of this patent is extended or adjusted under 35 U.S.C. 154(b) by 0 days.

(21) Appl. No.: 10/161,167

(22) Filed: May 30, 2002

Related U.S. Application Data

(60) Provisional application No. 60/356,249, filed on Feb. 11, 2002.

(51) Int. Cl.[7] ..... B63B 1/00
(52) U.S. Cl. ..... 114/61.15
(58) Field of Search ..... 114/39.21, 39.26, 114/39.28, 61.1, 61.15, 61.16, 61.17, 61.18

(56) References Cited

U.S. PATENT DOCUMENTS

| | | | | |
|---|---|---|---|---|
| 55,675 | A | 6/1866 | Knudsen et al. | |
| 2,106,432 | A | 1/1938 | McIntyre | |
| 2,495,190 | A | 1/1950 | Stewart | |
| 3,139,058 | A | 6/1964 | Robinson | |
| 3,179,960 | A | 4/1965 | Nimmo | |
| 3,400,685 | A | 9/1968 | Sydoriak | |
| 3,839,979 | A | 10/1974 | Wassell | |
| 4,159,006 | A | 6/1979 | Thurston | |
| 4,172,426 | A | 10/1979 | Susman | |
| 4,465,008 | A | 8/1984 | Liggett | |
| 4,909,169 | A | 3/1990 | Skandaliaris et al. | |
| 5,174,232 | A | 12/1992 | Boddy | |
| 5,277,142 | A | 1/1994 | Connor | |
| 5,373,799 | A | 12/1994 | Green | |
| 5,582,126 | A | 12/1996 | Rypinski | |
| 6,000,355 | A | 12/1999 | Hall | |
| 6,386,130 | B1 * | 5/2002 | Kuehne | 114/39.26 |

FOREIGN PATENT DOCUMENTS

| | | |
|---|---|---|
| DE | 3730-042 A | 11/1988 |
| SU | 524-728 | 4/1977 |

* cited by examiner

*Primary Examiner*—Ed Swinehart
(74) *Attorney, Agent, or Firm*—Fulbright & Jaworski

(57) ABSTRACT

A catamaran type water craft having two tandem pairs of scissors-like folding mechanisms disposed between and pivotally connecting to the opposing upright surfaces of adjacent, juxtaposed hulls. The folding mechanisms comprise two pairs of overlapped cross-linked beams joined about central pivot joints. A pair of cross-linked overlapped forward bow beams can also be provided, arranged so as to rise at an increasing angle to the water craft as the water craft collapses. When the boat is collapsed, the cross-linked beams fold like closing scissors to bring the opposing hulls laterally together, and the bow beams are drawn together, allowing the catamaran to fold to a width that can be transported by a truck or placed in a marina docking slip with the mast in its upright position. A mast is located in the pivot structure of the forward pair of crossed overlapped links.

16 Claims, 14 Drawing Sheets

COLLAPSIBLE CATAMARAN

CROSS-REFERENCE TO RELATED APPLICATION

This application claims the benefit of U.S. Provisional Patent Application Serial No. 60/356,249, filed Feb. 11, 2002.

BACKGROUND OF THE INVENTION

1. Field of the Invention

This invention generally relates to collapsible wind propelled and other water crafts.

2. Background Information

The superior nautical qualities of catamaran type water craft are well known. Their high beam-to-length ratio and their shallow draft provide desirable stability and resistance to capsizing, and they are faster than single hulled water craft. One drawback to catamarans is the awkward bulk of the double hull design which makes handling, transportation and storage difficult and inconvenient. The storage of conventional catamarans is expensive and inconvenient because it occupies a great deal more space than an equivalent sized single hull boat, which also makes it impossible to dock in narrow marina slips.

To overcome these problems, there have been attempts in the past to design a catamaran which collapses into a package that can be more readily transported or which can be contained in a marina slip/dock. Wassell U.S. Pat. No. 3,839,979 discloses a pair of hinged brace spars located on top of juxtaposed pontoons and operated by a control spar which juts out rearwardly and awkwardly when the catamaran is deployed. Skandaliaris et al U.S. Pat. No. 4,909,169 discloses a collapsible multiple hull boat using a tandem series of what is described as "scissor-like toggle mechanisms" between and connected by hinges to the opposing upright surfaces of juxtaposed hulls. Russian patent 524,728, discloses a collapsible catamaran having hulls joined by tandem pairs of pivotally movable powered arms. Hall U.S. Pat. No. 6,000,355 discloses a stabilized water craft employing two parallel, laterally spaced pontoons disposed on either side of the water craft for stabilizing the water craft. The pontoons are secured to the sides of the water craft with scissors-like extensor arms, one pair on each side of the water craft, which when collapsed, urge the pontoons toward the water craft. Each pair of extensor arms cross in scissors-like fashion and are connected at a central pivot joint. Nimmo U.S. Pat. No. 3,179,960 discloses a knock-down pontoon boat having laterally spaced, parallel pontoons that may be collapsed toward one another so as to decrease the width of the boat for hauling on vehicle tops. Scissors-like spacer members located on top of the Nimmo pontoons rotate about their pivot to lie substantially flat. Green U.S. Pat. No. 5,373,799, discloses a collapsible sailing rescue water craft provided with port and starboard pontoons that may be urged toward a center portion of the water craft via scissors-like struts that slide along rails on opposite sides of a central hull. French patent 2,610,890 discloses a catamaran having two opposing, parallel, laterally spaced hulls which can be pivotally collapsed toward a central bridge via tandem pivoting frame links connected on top of the hulls and which are not scissors-like structures. Susman U.S. Pat. No. 4,172,426, discloses a trimaran having outriggers or hulls that are pivotally collapsible with tandem swinging arms connected to top of the outriggers to reduce the width of the water craft. Knudsen et al U.S. Pat. No. 55,675 discloses tandem, scissors-like flat, horizontal bars mounted onto the top surface of pontoons to provide a portable life boat. Robinson U.S. Pat. No. 3,139,058 discloses a collapsible motor boat having collapsible hulls via pivotable frame members.

The foregoing designs have been either excessively complicated and expensive to manufacture and maintain, or flimsy and unseaworthy, and frequently require complicated and time consuming procedures for collapse. Moreover, they do not allow the mast of a sail to remain upright while collapsing the water craft while still floating on water. The need exists for a collapsible catamaran type water craft that has a traditional catamaran look and stability but which can be collapsed into a compact package while floating on the water, with the mast in place in its upright position for docking; the mast can be lowered when placed on a trailer.

SUMMARY OF THE INVENTION

The present invention provides such a catamaran type water craft. The two laterally spaced, parallel hulls of a catamaran are collapsed toward one another, while being maintained in an upright floating position, via two tandem pairs of scissors-like aft and fore folding mechanisms disposed between and pivotally connecting to the opposing upright surfaces of adjacent, juxtaposed hulls. The folding mechanisms comprise two pairs of overlapped cross-linked beams joined about central pivot joints. A center beam is disposed between and pivotally connects the aft and fore folding mechanisms. A pair of cross-linked overlapped forward bow beams can also be provided arranged so as to rise at an increasing angle to the water craft as the water craft collapses. When the boat is collapsed, the cross-linked beams fold like closing scissors to bring the opposing hulls laterally together, and the bow beams are drawn together, allowing the catamaran to fold to a width that can be transported by a truck or placed in a marina docking slip with the mast in its upright position. A mast is located in the pivot structure of the forward pair of crossed overlapped links, and retained in an upright position by the interaction of tensioning lines connecting the mast to the cross-linked fore beams and shrouds connecting the mast to opposite sides of the boat. Portions of the scissors-like structure forward of the pivot can be omitted if overlap of the pivot areas is retained.

The invention thus has several important structural features, all of which work together to provide a catamaran that can be collapsed while still floating so that it may be easily maneuvered into a standard marina boat slip. The mast can be retained in an upright disposition until it is desired to lower it to place the catamaran on a trailer.

The prior art has not appreciated the combination of structural features presented by the present invention. None of the prior art of which applicant is aware discloses the disposition of the mast of a sail on a pivot joint, and the prior art is deficient in other respects. Wassell U.S. Pat. No. 3,839,979 does not disclose the tandem disposition of overlapped scissors-like struts between and pivotally connecting to the opposing upright surfaces of juxtaposed hulls. The toggle mechanisms of Skandaliaris et al U.S. Pat. No. 4,909,169 do not permit overlap of the pivot areas. Russian patent 524,728 does not disclose overlapped scissors-like struts. Hall U.S. Pat. No. 6,000,355 does not disclose the tandem disposition of the pairs of extensor arms between and pivotally connecting to the opposing upright surfaces of juxtaposed hulls. Nimmo U.S. Pat. No. 3,179,960 does not disclose the tandem disposition of pairs of the spacer members between and pivotally connecting to the opposing upright surfaces of juxtaposed hulls. Green U.S. Pat. No. 5,373,799 does not disclose the tandem disposition of the scissors-like struts between and pivotally connecting to the opposing upright surfaces of juxtaposed hulls. French patent 2,610,890 does not disclose overlapped scissors-like struts between and pivotally connecting to the opposing upright surfaces of juxtaposed hulls. Susman U.S. Pat. No. 4,172,426 does not disclose the tandem disposition of pairs of overlapped scissors-like arms between and pivotally connecting to the opposing upright surfaces of juxtaposed hulls. Knudsen et al U.S. Pat. No. 55,675 does not disclose the arms disposed between and pivotally connecting to the opposing upright surfaces of juxtaposed hulls. Robinson U.S. Pat. No. 3,139,058 does not disclose scissors-like arms between and pivotally connecting to the opposing upright surfaces of juxtaposed hulls The foregoing has outlined rather broadly the features and technical advantages of the present invention in order that the drawings of the invention that follows may be better understood. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention. The novel features which are believed to be characteristic of the invention, both as to its organization and method of operation, will be better understood from the accompanying figures. It is to be expressly understood, however, that each of the figures is provided for the purpose of illustration and description only and is not intended as a definition of the limits of the present invention.

DETAILED DESCRIPTION

Figure 1:
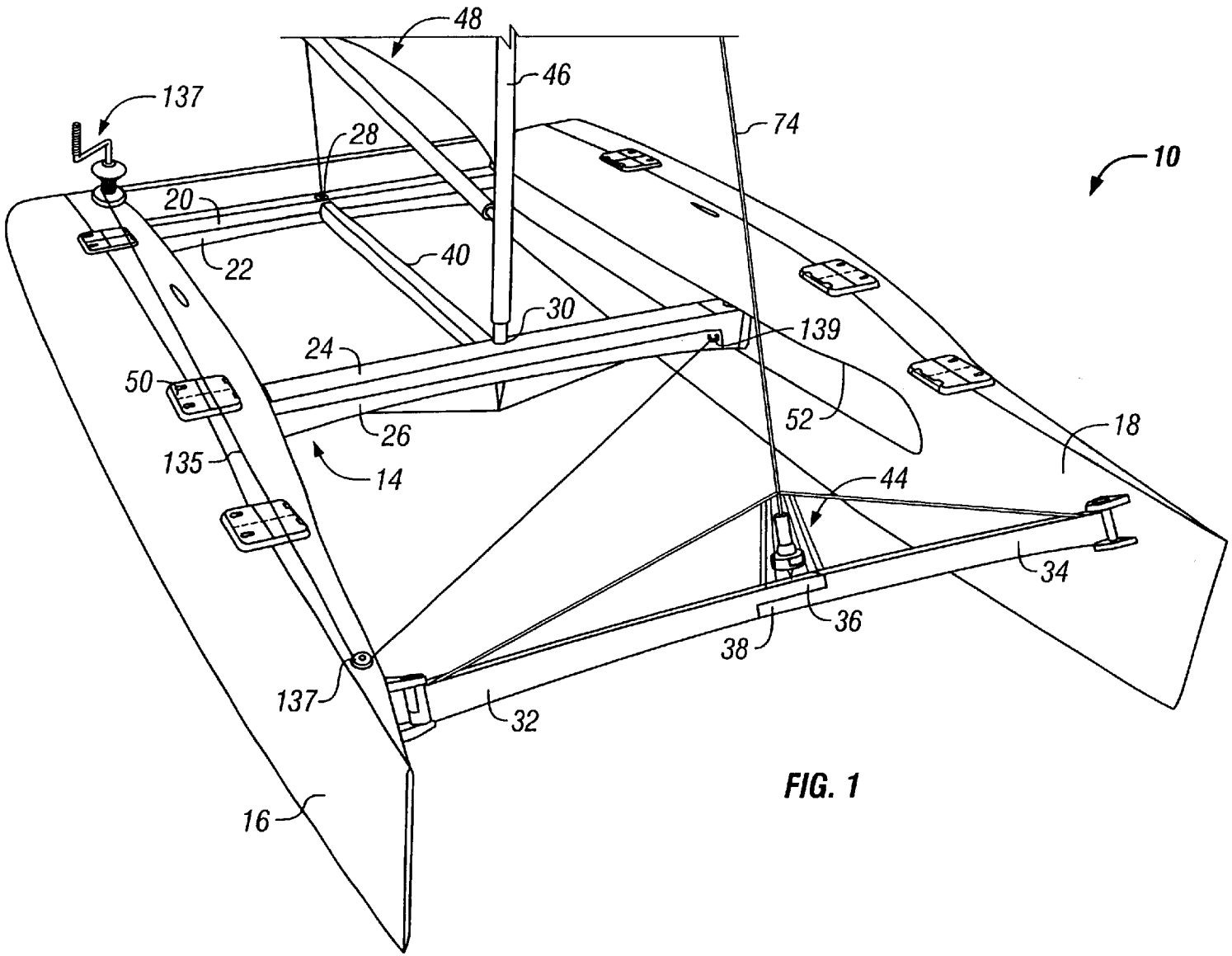
FIG. 1 is a one quarter forward view of the catamaran type water craft of this invention fully deployed.
Figure 2:
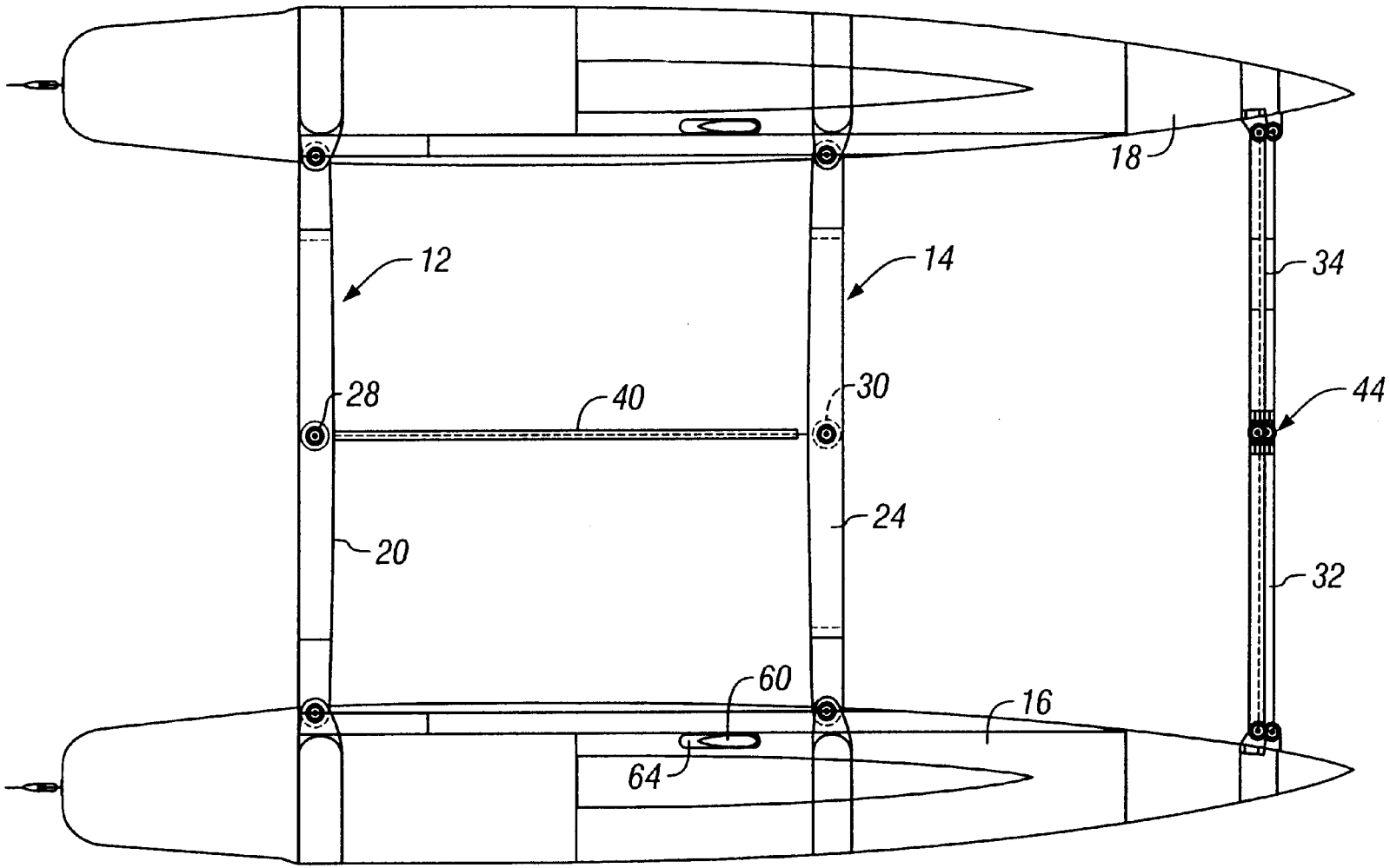
FIG. 2 is a top plan view of the catamaran type water craft of FIG. 1.

Referring to FIGS. 1, 2, 3, and 4, the catamaran water craft 10 of the present invention is depicted fully deployed. The water craft 10 is collapsible by means of two tandem pairs of scissors-like folding mechanisms 12 and 14 disposed between and pivotally connecting to the opposing upright surfaces of adjacent, juxtaposed hulls 16 and 18. Each folding mechanism 12 and 14 comprises two pairs of overlapped cross-linked beams, respectively aft upper and lower beams 20 and 22 and fore, or mast, upper and lower beams 24 and 26, joined about central pivot joints, respectively 28 and 30. A pair of linked forward bow beams 32 and 34 can also be provided. When the boat is collapsed, the cross-linked beams 20, 22, 24 and 26 fold like closing scissors to bring the opposing hulls 16 and 18 laterally together, and the bow beams 32 and 34 are drawn together. The bow beams 32 and 34 are formed with corresponding overlapped mating sections, respectively 36 and 38, which nest with each other when the bow beams 32 and 34 are fully extended and rise at an increasing angle to the water craft 10 as the water craft 10 collapses.

Figure 13:
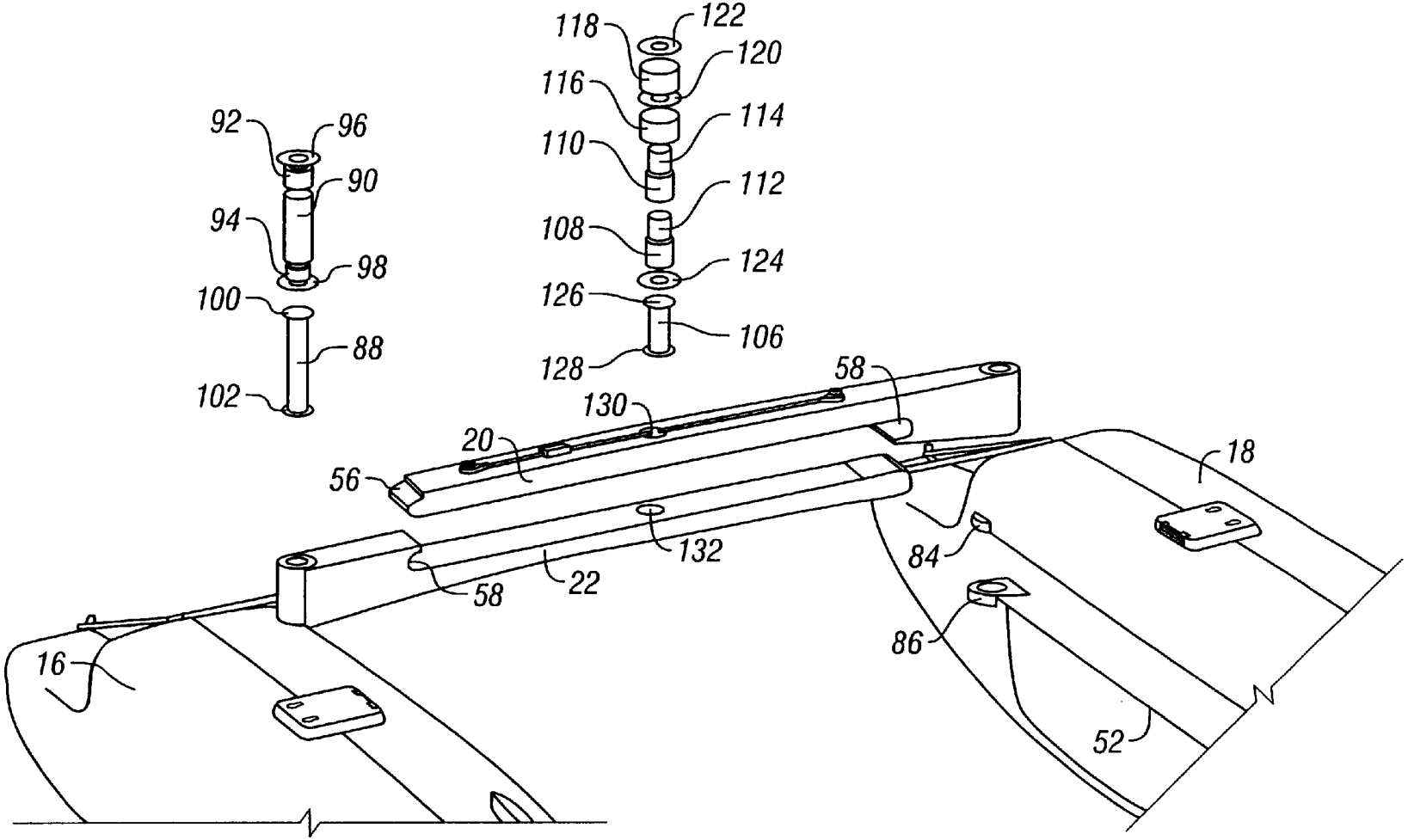
FIG. 13 is a perspective exploded view of the aft cross-linked beams.
Figure 14:
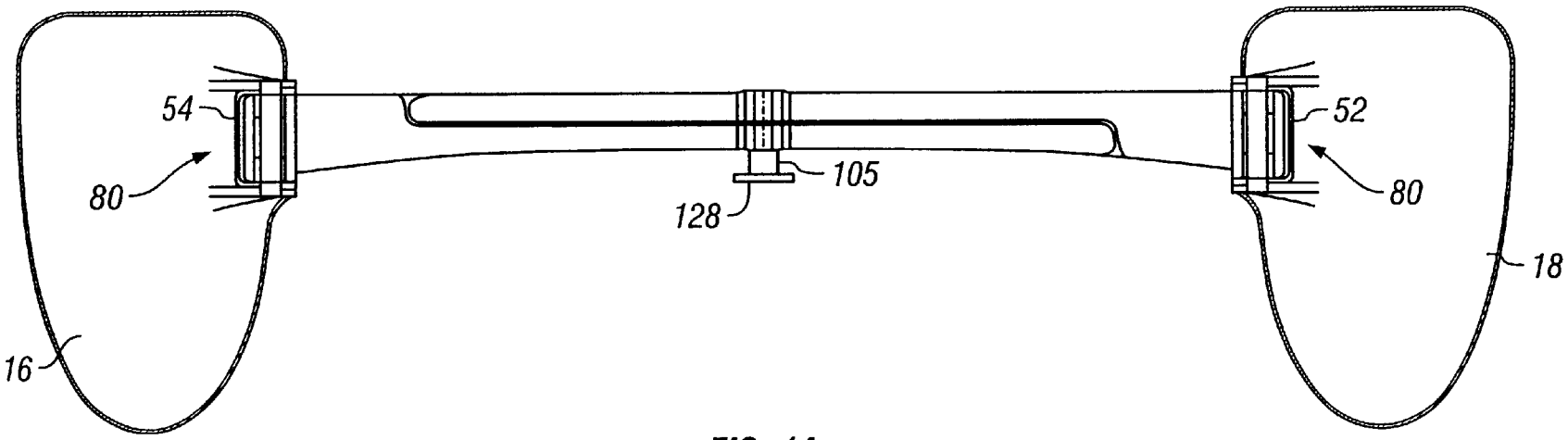
FIG. 14 is a front view of the aft cross-linked beams, with adjacent hull portions in cross-section.

A center beam 40 is pivotally secured between the aft and fore pivot joints 28 and 30 by a bearing 105 on a lower extension of the tube 106 of the aft center bushing 82 (FIGS. 13 and 14). A pivot mechanism 44 (which also includes a roller furler) is connected to the bow beams 32 and 34.

The bottom of a mast 46 of a sail assembly 48 is contained in and extends from the mast beam pivot joint 30, which will be described in more detail when describing FIG. 13. By locating the mast 46 at the pivot joint 30, the sail assembly 48 can be retained in an upright disposition until it is desired to lower it to place the water craft 10 on a trailer. This allows the water craft 10 to be collapsed while still afloat so that it can be maneuvered into a boat slip, and to be ready to sail when maneuvered out of the slip and expanded to its fully deployed configuration.

Figure 5:
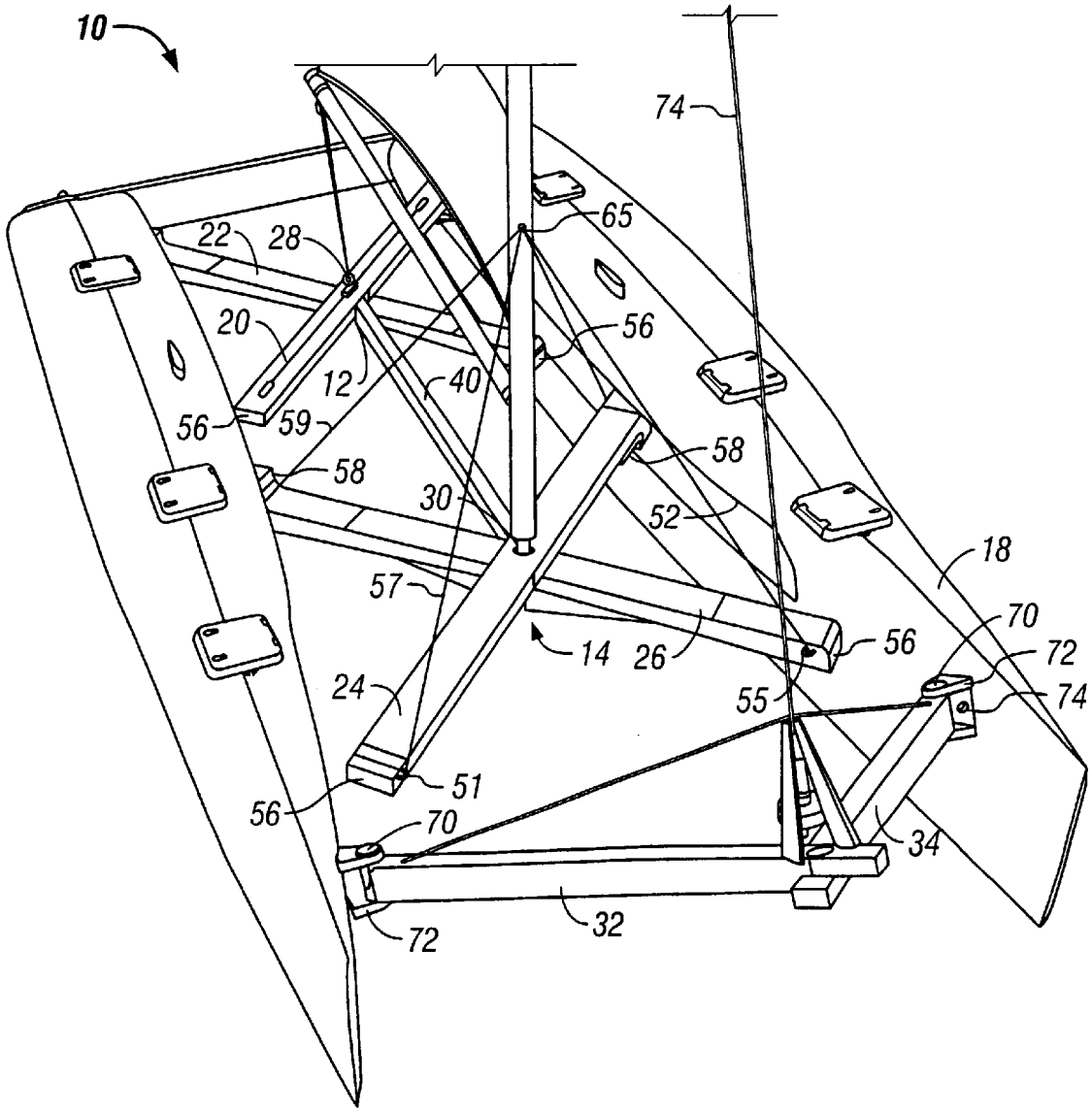
FIG. 5 is a one quarter forward view of the catamaran type water craft of this invention partially collapsed to about 45% of its fully deployed width.
Figure 12C:
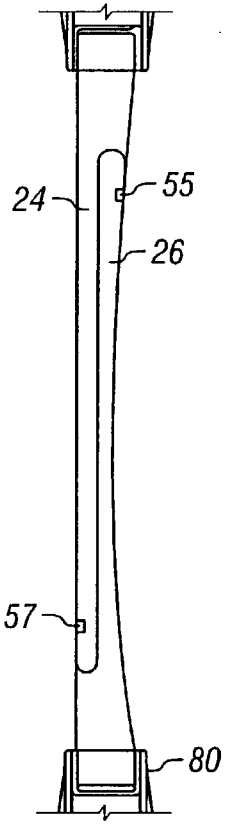
FIGS. 12*a*, 12*b* and 12*c* are respectively top, bottom and face views of the forward cross-linked beams.
Figure 12B:
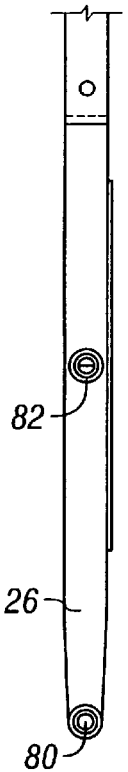
Figure 12A:
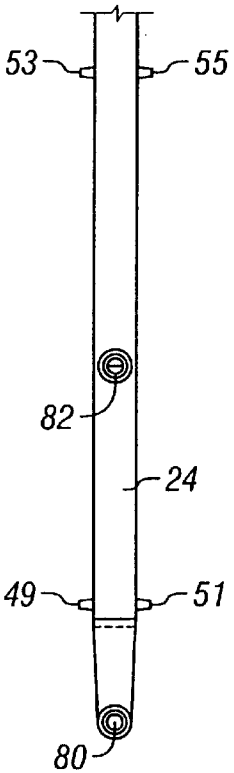

In a particular embodiment of the invention, a significant advantage is obtained in the method provided herein of retaining the mast 46 in an upright position. Referring to FIGS. 5 and 12(*a*) and 12(*c*), each of the fore upper and lower beams 24 and 26 are provided on alternate sides with eye pads 49, 51, 53 and 55, to which are tied lines 57, 59, 61 and 63 which, in turn, are tied at 65 to the mast 46. As the water craft is collapsed, forward movement of the fore beams 24 and 26 substantially retains the tension in the lines 57, 59, 61 and 63 to help maintain the mast 46 in an upright position.

Figure 3:
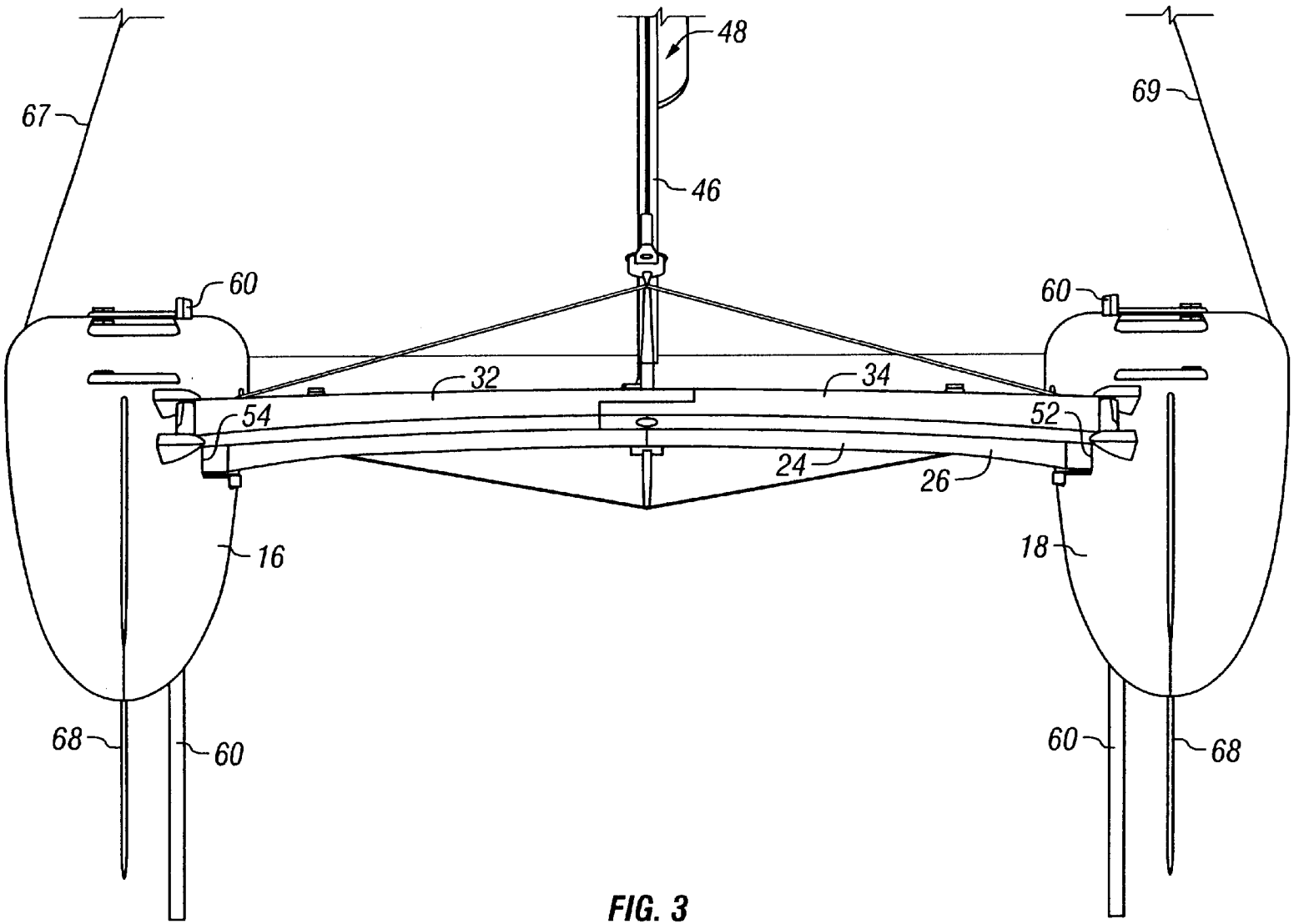
FIG. 3 is a forward view of the catamaran type water craft of FIG. 1.
Figure 4:
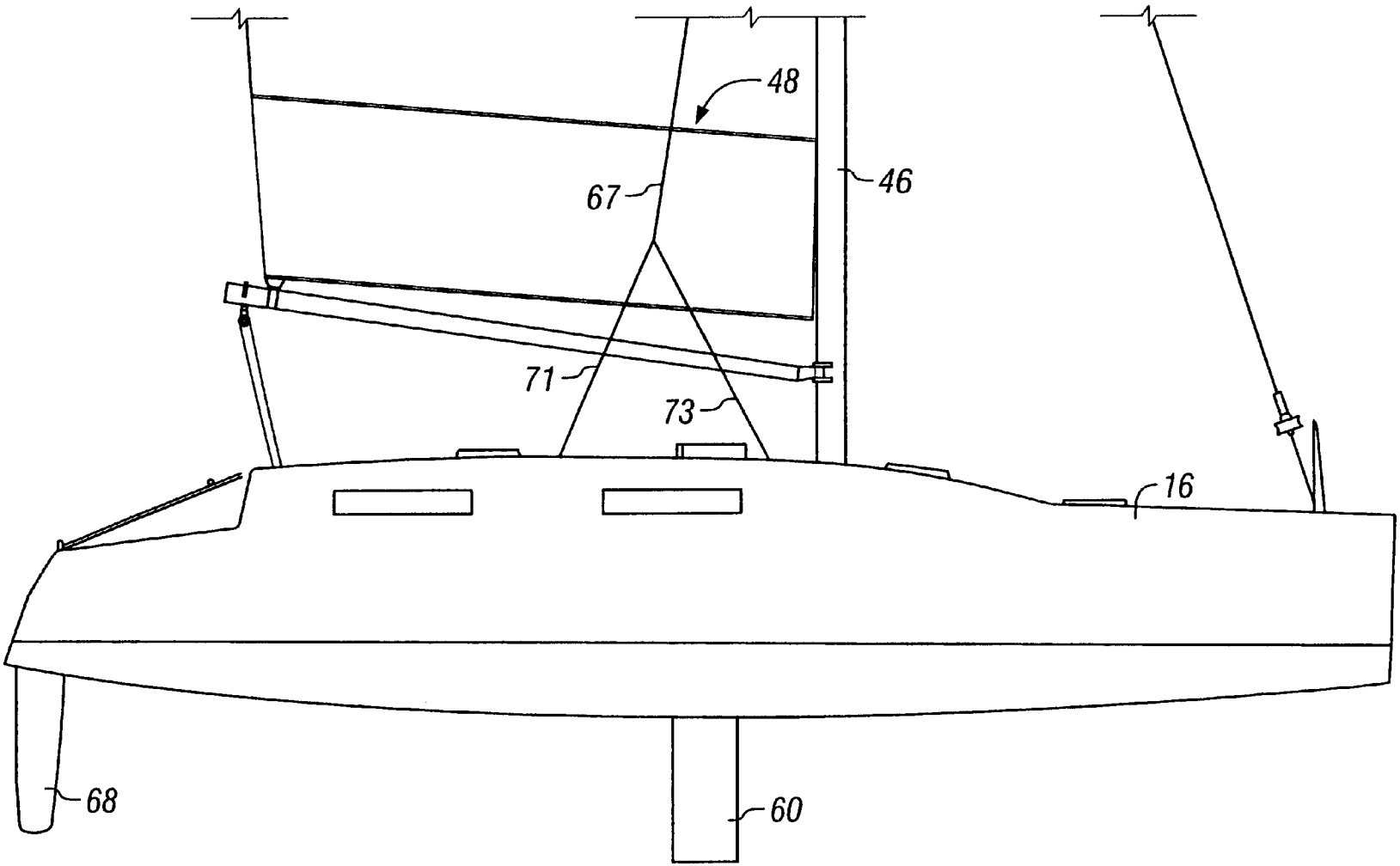
FIG. 4 is a side view of the catamaran type water craft of FIG. 1.

Referring also to FIGS. 3 and 4, shrouds 67 and 69 (having branches such as at 71,73; opposite branches hidden) are tied to the respective hulls 16 and 18 and to the mast 46 at the top thereof (not shown) to provide additional stability when the water craft is fully deployed. When collapsing the water craft, one loosens the shrouds to slacken them but tension is substantially maintained by the aforesaid lines 57, 59, 61 and 63. When the water craft is fully collapsed, the lines 57, 59, 61 and 63 provide little side support but the shrouds 67 and 69 are then manually retensioned. The result is the unprecedented ability to stabily keep the mast 46 upright during and after collapse of the water craft.

The top surfaces of the hulls 16 and 18 are fitted with hatches 50, which in this particular catamaran (a 36 foot boat) are about 2 feet square and allow ventilation and light, and even entrance, to the hulls which contain sleeping and dining quarters as would be expected in a luxury size catamaran. Decking (not shown in FIGS. 1–4 for clarity of illustration) will be described hereinafter. The opposing upright surfaces of respective hulls 16 and 18 are formed with respective elongate port and starboard C-shaped channels 52 and 54 (more clearly shown in FIGS. 3, 15 and 15), The channels 52 and 54 are of a width, depth and length sufficient to accommodate scissors-like folding of the lower aft and fore beams 22 and 26 (FIG. 5), as will be further described below. The ends of the cross-linked beams 20, 22, 24 and 26 are formed with openings through which bushings are disposed on tubes fixed within the channels 52 and 54, as will be described in more detail below with respect to FIG. 13 Referring momentarily to FIG. 13, one end of each beam 20, 22, 24 and 26 is formed with a tongue 56 and the other end with a groove 58 whereby the tongue 56 of a top beam 20 (or 24), slides into and out of the groove 58 on a bottom beam 22 (or 26) and the tongue 56 of a bottom beam 22 (or 26), slides into and out of the groove 58 on a top beam 20 (or 24). The grooves 58 are formed as returns at the respective ends of each beam 20, 22, 24 and 26.

Daggerboards 60 (FIGS. 2, 3 and 4), extending through respective hull slots 64 and skegs (68 in FIG. 4), are provided for stability and steering, as usual.

Figure 6:
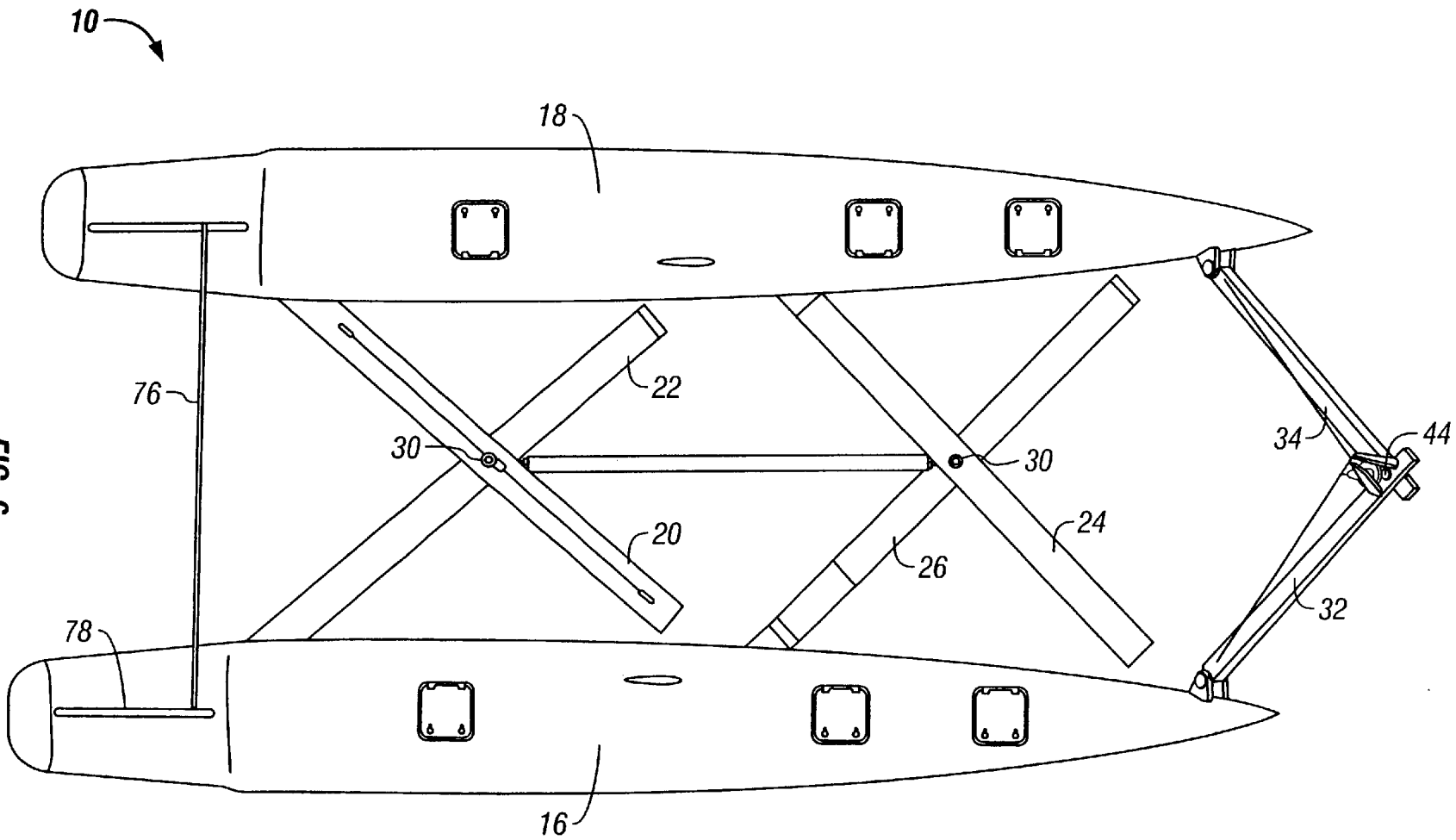
FIG. 6 is a top view of the catamaran type water craft of FIG. 5.
Figure 7:
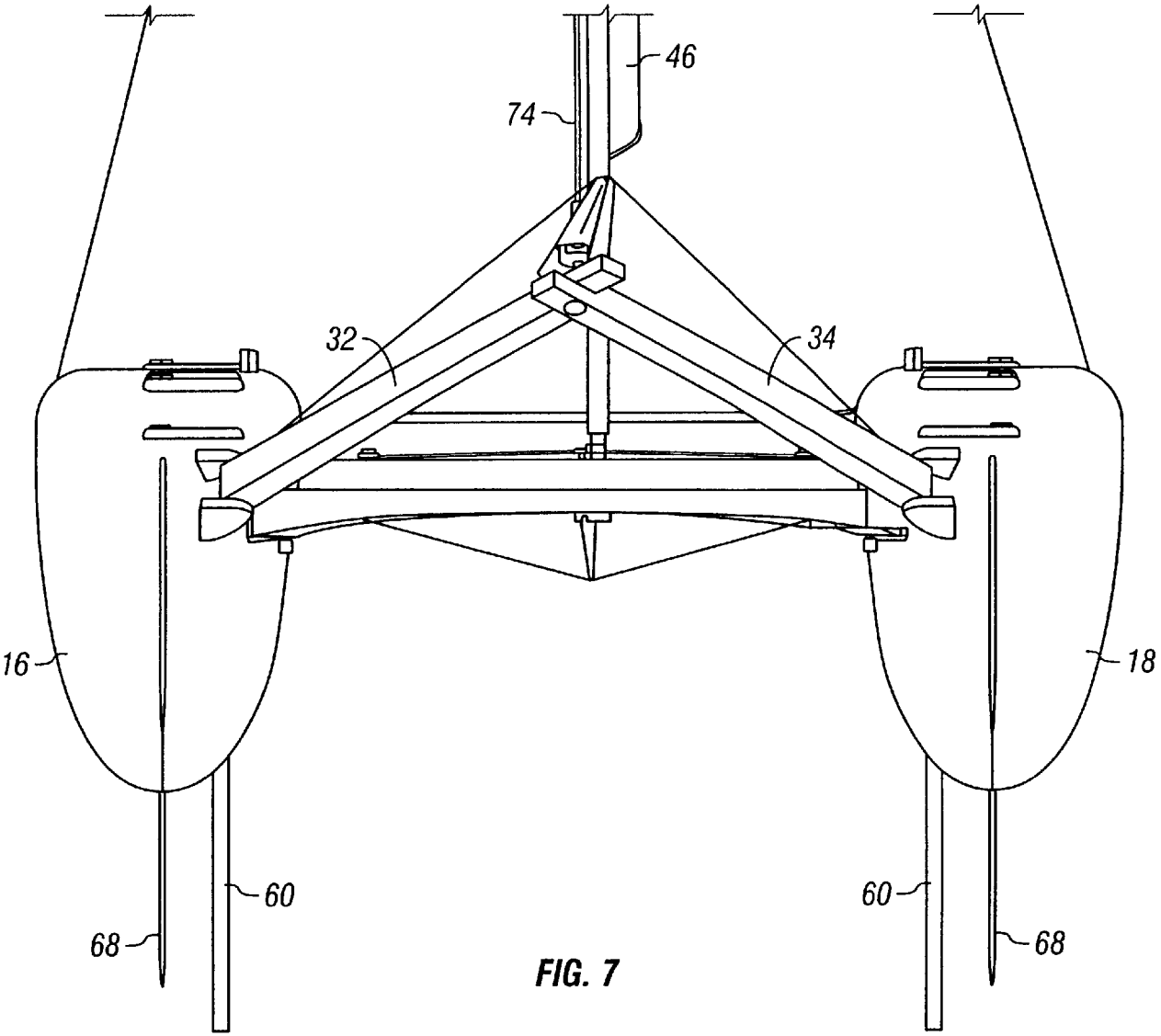
FIG. 7 is a forward view of the catamaran type water craft of FIG. 5.
Figure 8:
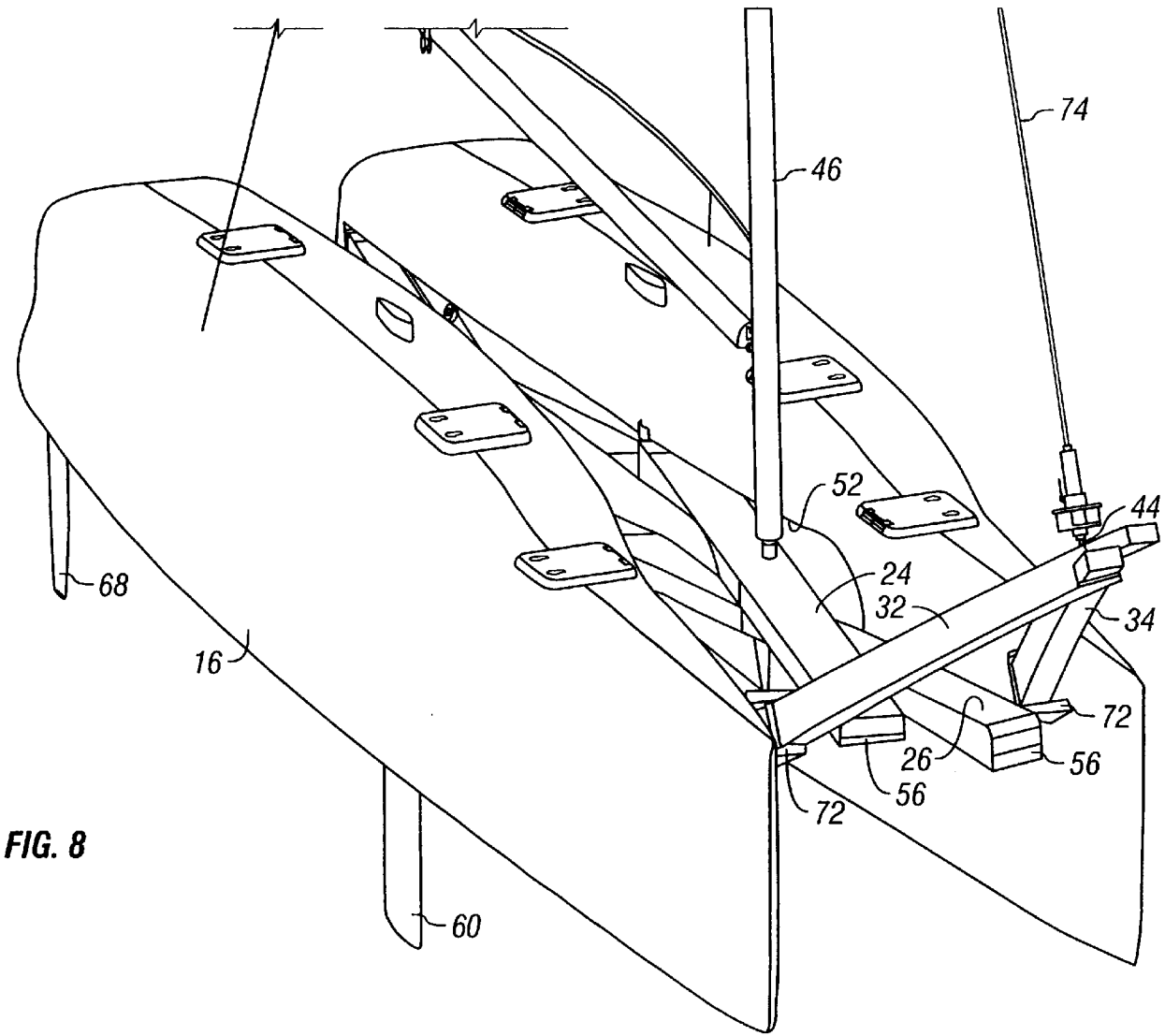
FIG. 8 is a one quarter forward view of the catamaran type water craft of this invention collapsed to about 90% of its fully deployed width.
Figure 9:
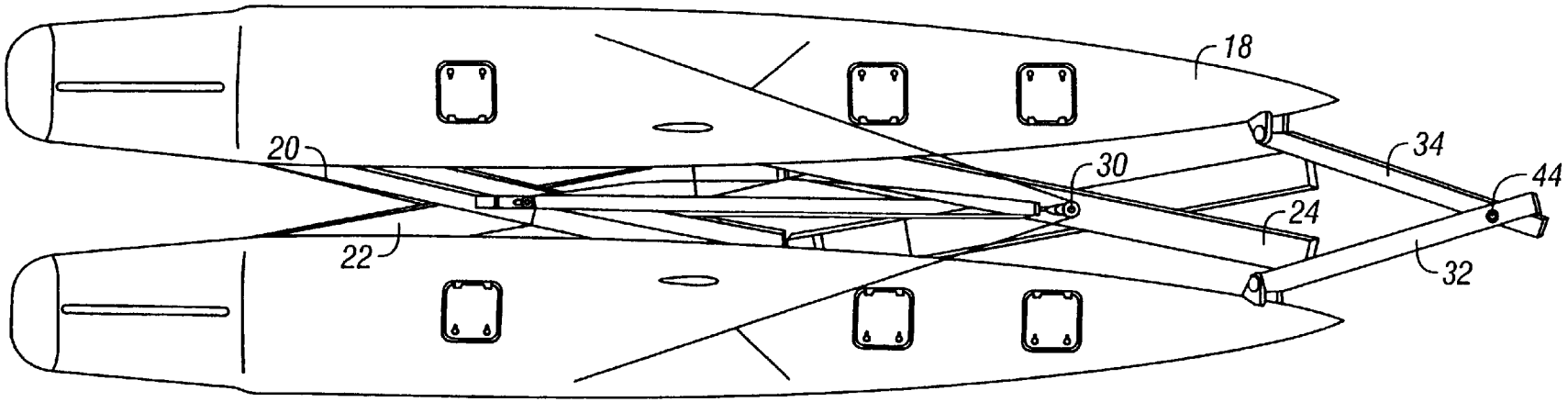
FIG. 9 is a top view of the catamaran type water craft of FIG. 8.
Figure 10:
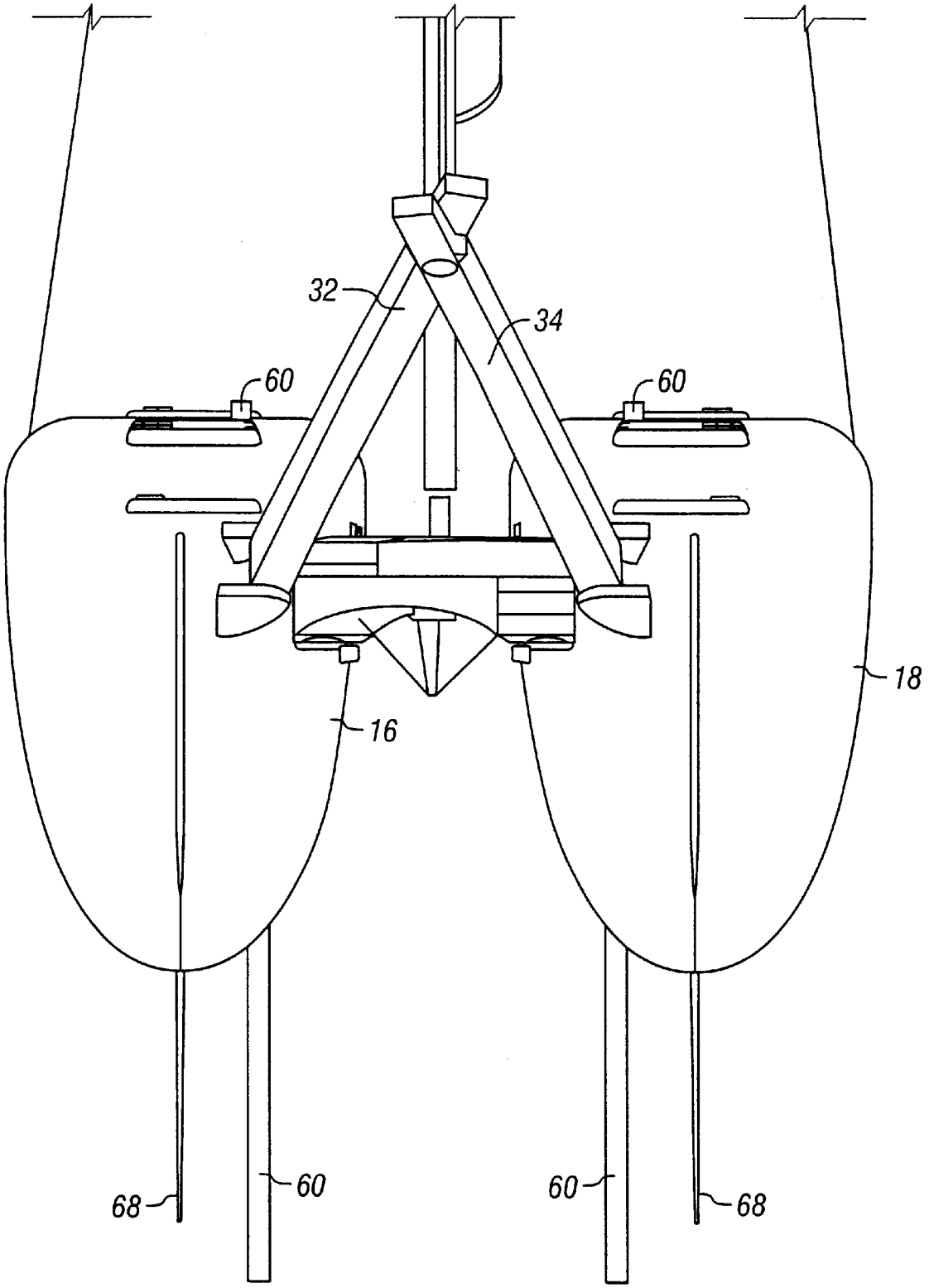
FIG. 10 is a forward view of the catamaran type water craft of FIG. 8.

Referring to FIGS. 5 through 10, the catamaran water craft 10 is depicted partially collapsed, about 45% in FIGS. 5–7 and about 90% in FIGS. 8–10. The beam links of the scissors-like folding mechanisms 12 and 14, including the two pairs of cross-linked beams, respectively 20, 22 and 24,26, are joined about central pivot joints 28 and 30, and the pair of linked forward bow beams, are collapsed. As the scissors-like links open, collapsing the water craft 10, the bow beams 32 and 34 angle upwardly, reaching an angle of about 45 degrees when the water craft 10 is collapsed about 90%.

The ends of the bow beams 32 and 34 are each formed with a through hole (hidden) into which the shank 70 of a flat-metal shackle 72 is disposed, each shackle 72 being connected by a swivel to the upright surface of the respective hull 16 or 18. The bow beams 32 and 34 are pivotally connected by the pivot mechanism 44 which also serves to secure the fore stay 74 of the mast rigging to the bow beams 32 and 34. At the other, aft, end of the craft 10, a tiller bar 76 is connected at its opposite ends to tillers 78 connected to respective skegs 68. The tiller bar 71 can be removed when the water craft is collapsed (and can be substituted with a shorter bar if desired).

Figure 11C:
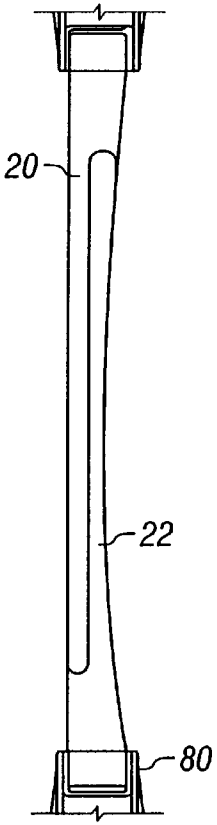
FIGS. 11*a*, 11*b* and 11*c* are respectively top, bottom and face views of the aft cross-linked beams.
Figure 11B:
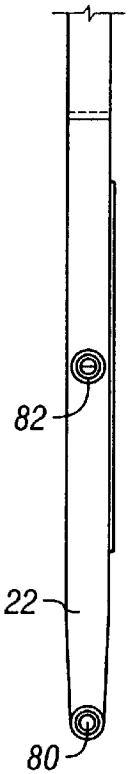
Figure 11A:
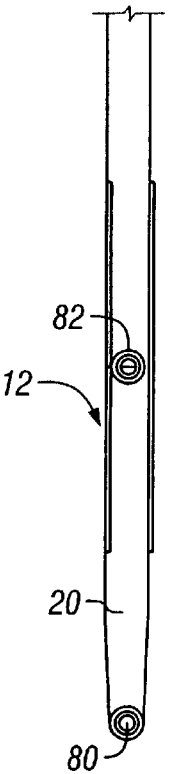

Referring to FIGS. 11 through 16, details of the cross-linked aft and fore scissors-like mechanisms 12 and 14 are shown with more particularity. In FIGS. 11 and 12, top, bottom and elevational view are given for the aft and fore cross-linked beams, respectively. FIGS. 13 and 14 provide details of end bushings 80 on the end of each beam 20, 22, 24 and 26 pivotally secured within the channels 52 and 54, and of center bushings 82 inter-linking the aft beams 20 and 22 and the mast beams 24 and 26.

Referring specifically to FIGS. 13 and 14, where the coupling for the aft beams 20 and 22 are shown (the mast beam assembly is the same), the ends of the beams are secured in reinforced recesses 84 and 86 respectively in the upper and lower walls of the C-shaped channels 52 and 54 by means of the end bushings 80. Each end bushing 80 comprises a stainless steel tube 88 carried in a composite sleeve 90 and extending through top and bottom thorodon bushings, respectively 92 and 94. Top and bottom teflon spacers, respectively 96 and 98, are sandwiched respectively by a pressed-on cap 100 and a fastened base cap 102. The assembly fits in an opening 104 in the end of the respective beam, 22 in the illustration.

Each center bushing 82 comprises a stainless steel tube 106 carried in two tandem sub-assemblies of composite sleeves 108 and 110 and thorodon bushings 112 and 114, toped by two composite covers 116 and 118 separated by a teflon spacer 120. Top and bottom teflon spacers, respectively 122 and 124, are sandwiched respectively by a pressed-on cap 126 and a fastened base cap 128. The assembly fits in openings 130 and 132 respectively in the centers of the respective beam 20 and 22 in the illustration.

The mast (fore) beams 24 and 26 are connected in identical fashion as the aft beams 20 and 22, except that in place of the pressed on cap 126, the stem of a standard mast ball socket is pressed into the top end of the tube 106, to which is connected the mast 46, which is also standard. This structure enables the mast 46 to rotate while the aft and mast beams 20, 22, 24 and 26 are collapsing.

Referring back to FIG. 1, to collapse the water craft 10, a winch 133 can be secured to the aft position of one of the hulls 16 from which a winch line 135 extends via a wheel block 137 to an eye pad 139 on the opposite lower mast beam 26 (alternative connections can be made and/or other mechanisms can be used). This causes the aft and fore cross-linked beams, respectively 20,22 and 24,26 to collapse in scissors-like, overlap fashion which moves the tongues 56 on the outer ends of the beams 20, 22, 24 and 26 out, accommodated by the channels 52 and 54, drawing the catamaran type water craft hulls 16 and 18 toward each other. To unfold the water craft from a collapsed position, one can connect the wench line to an eye pad (not shown) on the rear side of the relevant bow beam.

Placing the deck (see FIG. 16) in place locks the water craft in its fully deployed configuration. Additionally, or alternatively, one can use bolts to retain the beams in an fully deployed position. When in a fully folded position, a line can be used to tie the hulls together.

In a further embodiment of the invention, the portions of the scissors-like structure forward of the pivot can be omitted while retaining overlap of the pivot areas. For example, and referring to the top and bottom aft beams in FIG. 13, the material of the bottom beam 22 defining the groove 58 can be extended to be located adjacent the central opening 132 and the top beam 20 can be shortened so that its tongue 56 fits in the groove 58. Alternatively, one can utilize any bracket mechanism in place of the tongue 56 and groove 58 structure.

Figure 15:
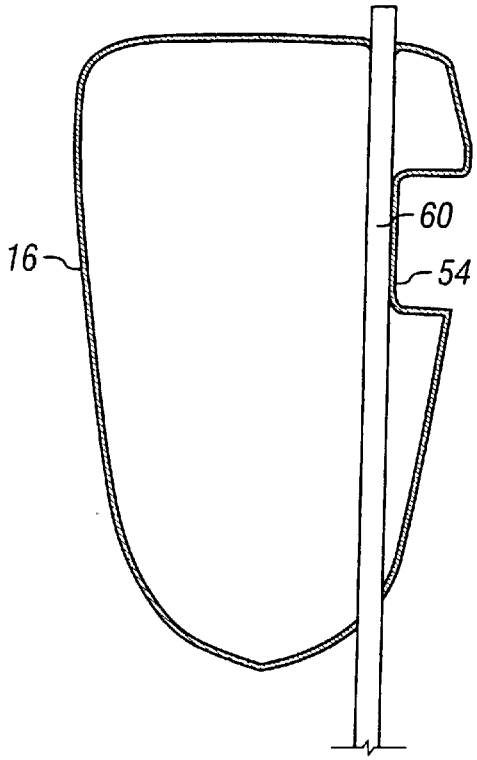
FIG. 15 is a cross-section of one of the hulls of the catamaran type water craft, showing a cross-section of one of the dagger boards.

The water craft hulls 16 and 18 are hollow as are the aft and mast beams 20, 22, 24 and 26 and the bow beams 32 and 34. FIG. 15 shows a section through one of the hulls, e.g., 16, through which a daggerboard 60 has been disposed.

Figure 16:
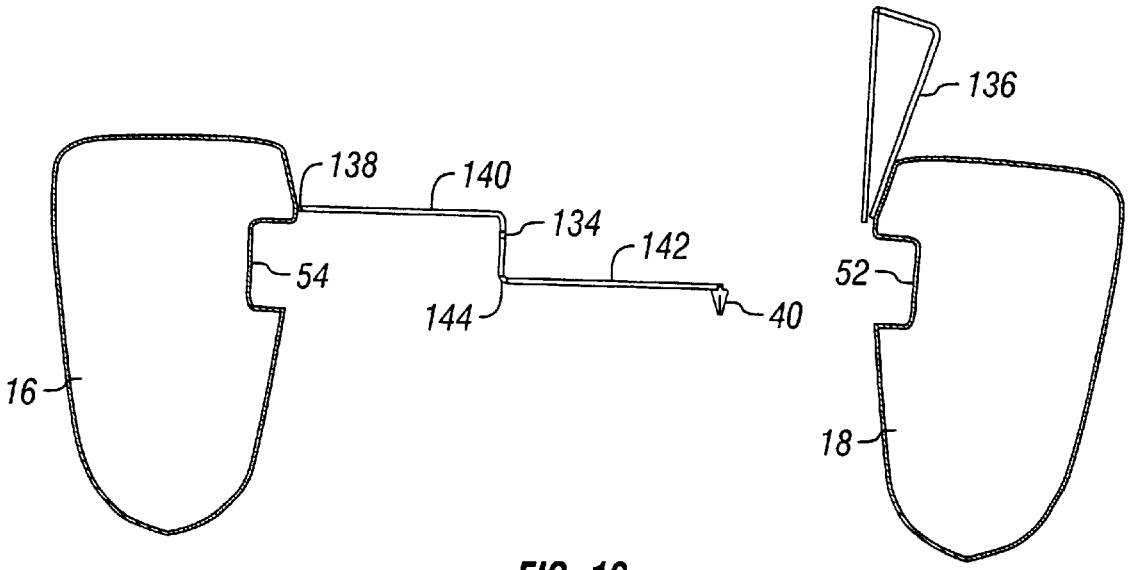
FIG. 16 is a cross-section of opposing hulls of the catamaran type water craft, showing cross-sections of a folding deck used on the water craft.

Referring to FIGS. 1 and 16, the cross-sectional shape of the aft center beam 40 is shown. An aft deck is formed of an aft starboard half deck 134 and a fore port half deck 136. The starboard half deck is connected by a piano hinge 138 to the port surface of the starboard hull 16, just above the C-shaped channel 54 and extends from the aft beams 20,22 to the mast beams 24,26. A first section 140 of the starboard half deck 134 has a step down bend 142 connected by a piano hinge 144 to a second section 146, the outer edge of which overlies part of the aft center beam 40. The port half deck 138 is similarly constructed and disposed and is shown in FIG. 16 folded to an upright position. If desired, a net can be placed forward of the mast beams 24,26, linking the hulls 16 and 18.

It should be understood that various changes, substitutions and alterations can be made herein without departing from the spirit and scope of the invention. The scope of the present application is not intended to be limited to the particular embodiments depicted. As one of ordinary skill in the art will readily appreciate from the disclosure of the present invention, articles of manufacture later to be developed that perform substantially the same function or achieve substantially the same result as components used in the embodiment disclosed herein may be utilized according to the present invention.

What is claimed is:

1. A collapsible water craft having adjacent juxtaposed hulls with opposing upright side surfaces, comprising:

at least one folding mechanism comprising a pair of overlapped cross-linked top and bottom beams disposed between and pivotally connecting to the opposing upright side surfaces of said adjacent juxtaposed hulls, whereby folding of the beams in scissors fashion moves the hulls together while maintaining them upright to collapse the water craft to a smaller width; and a mast carried by the folding mechanism so as to remain upright during collapse of the water craft.

2. The water craft of claim 1, comprising shrouds connecting the mast to opposite sides of the water craft to enable the mast to be secured in a upright position when the water craft is fully collapsed.

3. The water craft of claim 1 in which the overlapped cross-linked beams are joined about a pivot joint, said mast being carried in said pivot joint.

4. A collapsible water craft having adjacent juxtaposed hulls with opposing upright side surfaces, comprising:

at least one folding mechanism comprising a pair of overlapped cross-linked top and bottom beams disposed between and pivotally connecting to the opposing upright side surfaces of said adjacent juxtaposed hulls, whereby folding of the beams in scissors fashion moves the hulls together while maintaining them upright to collapse the water craft to a smaller width;

a mast carried by the folding mechanism so as to remain upright during collapse of the water craft; and lines connecting the mast to said cross-linked beams to substantially maintain tension on the mast as the water craft is collapsed.

5. The watercraft of claim 4 in which said lines connect the mast to each end of each of said cross-linked beams.

6. A collapsible water craft having adjacent juxtaposed hulls with opposing upright side surfaces, comprising:

at least one folding mechanism comprising a pair of overlapped cross-linked top and bottom beams disposed between and pivotally connecting to the opposing upright side surfaces of said adjacent juxtaposed hulls, whereby folding of the beams in scissors fashion moves the hulls together while maintaining them upright to collapse the water craft to a smaller width;

a mast carried by the folding mechanism so as to remain upright during collapse of the water craft; and a pair of cross-linked overlapped forward bow beams arranged so as to rise at an increasing angle to the water craft as the water craft collapses.

7. A collapsible water craft having adjacent juxtaposed hulls with opposing upright side surfaces, comprising:

at least one folding mechanism comprising a pair of overlapped cross-linked top and bottom beams disposed between and pivotally connecting to the opposing upright side surfaces of said adjacent juxtaposed hulls, whereby folding of the beams in scissors fashion moves the hulls together while maintaining them upright to collapse the water craft to a smaller width;

a mast carried by the folding mechanism so as to remain upright during collapse of the water craft; and opposed elongate channels formed in the opposing surfaces of said hulls allowing clearance for movement of the outer edges of the cross-linked beams when the beams are folded.

8. The water craft of claim 7 in which said channels are C-shaped.

9. A collapsible water craft having adjacent juxtaposed hulls with opposing upright side surfaces, comprising:

at least one folding mechanism comprising a pair of overlapped cross-linked top and bottom beams disposed between and pivotally connecting to the opposing upright side surfaces of said adjacent juxtaposed hulls, whereby folding of the beams in scissors fashion moves the hulls together while maintaining them upright to collapse the water craft to a smaller width; and a mast carried by the folding mechanism so as to remain upright during collapse of the water craft;

wherein each of the beams is pivotally connected to a respective hull and has a free end formed with a tongue, a section of each beam adjacent its pivotal connection being formed with a groove shaped to receive the tongue of the other beam.

10. A collapsible water craft, comprising:

aft and fore tandem folding mechanisms, each comprising a pair of overlapped cross-linked top and bottom beams joined about a pivot joint and disposed between and pivotally connecting to the opposing upright surfaces of adjacent juxtaposed hulls, whereby folding of the beams in scissors fashion moves the hulls together to collapse the water craft to a smaller width;

each of the beams being pivotally connected to a respective hull, each having a free end formed with a tongue, a section of each beam adjacent its pivotal connection being formed with a groove shaped to receive the tongue of the other beam;

a center beam disposed between and pivotally connecting the aft and fore folding mechanisms;

a deck between the aft and fore folding mechanisms;

opposed elongate C-shaped channels formed in the opposing surfaces of said hulls allowing clearance for movement of the outer edges of the cross-linked beams when the beams are folded;

a mast carried by the pivot joint of the fore folding mechanism so as to remain upright during collapse of the water craft;

lines connecting the mast to said cross-linked beams to substantially maintain tension on the mast as the water craft is collapsed; and shrouds connecting the mast to opposite sides of the water craft to enable the mast to be secured in a upright position when the water craft is fully collapsed.

11. A collapsible water craft having adjacent juxtaposed hulls with opposing upright side surfaces, comprising:

aft and fore folding mechanisms, each comprising a pair of overlapped cross-linked top and bottom beams disposed between and pivotally connecting to the opposing upright surfaces of said adjacent juxtaposed hulls, whereby folding of the beams in scissors fashion moves the hulls together while maintaining them upright to collapse the water craft to a smaller width; and a center beam disposed between and pivotally connecting the aft and fore folding mechanisms to be movable therewith.

12. The water craft of claim 11 including a deck between the aft and fore folding mechanisms.

13. The water craft of claim 12 in which the deck is formed in halves, each having an outer edge pivotally secured to a hull surface and an inner edge supported by the center beam.

14. A collapsible water craft having adjacent juxtaposed hulls with opposing upright side surfaces spaced a predetermined distance from each other when the craft is fully deployed, comprising:

at least one folding mechanism comprising a pair of overlapped cross-linked top and bottom beams disposed between and pivotally connecting to the opposing upright surfaces of said adjacent juxtaposed hulls, whereby folding of the beams in scissors fashion moves the hulls together while maintaining them upright to collapse the water craft to a smaller width, said beams being fully overlapped when said craft is fully deployed, the beams are fully overlapped and the length of each beam is shorter than said predetermined distance.

15. A collapsible water craft having adjacent juxtaposed hulls with opposing upright side surfaces, comprising:

at least one folding mechanism comprising a pair of overlapped cross-linked top and bottom beams disposed between and pivotally connecting to the opposing upright side surfaces of said adjacent juxtaposed hulls, whereby folding of the beams in scissors fashion moves the hulls together while maintaining them upright to collapse the water craft to a smaller width;

a pair of cross-linked overlapped forward bow beams arranged so as to rise at an increasing angle to the water craft as the water craft collapses; and a line connecting said mast to said forward bow beams.

16. The water craft of any one of claims 1 to 15 wherein the water craft is a catamaran.

* * * * *